US008328325B2

(12) United States Patent
Yamaguchi

(10) Patent No.: US 8,328,325 B2
(45) Date of Patent: Dec. 11, 2012

(54) LIQUID DISCHARGE APPARATUS HAVING CLEANING BELTS IN THE SHAPE OF A MOBIUS STRIP AND METHOD OF CONTROLLING THE SAME

(75) Inventor: Shunji Yamaguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 316 days.

(21) Appl. No.: 12/695,578

(22) Filed: Jan. 28, 2010

(65) Prior Publication Data

US 2010/0201741 A1 Aug. 12, 2010

(30) Foreign Application Priority Data

Feb. 12, 2009 (JP) ..... 2009-030537

(51) Int. Cl.
*B41J 2/165* (2006.01)
*B41J 2/155* (2006.01)

(52) U.S. Cl. ..... 347/33; 347/42

(58) Field of Classification Search ..... 347/33
See application file for complete search history.

(56) References Cited

U.S. PATENT DOCUMENTS

| | | | | |
|---|---|---|---|---|
| 3,847,480 | A * | 11/1974 | Fisher | 399/346 |
| 4,577,203 | A * | 3/1986 | Kawamura | 347/30 |
| 2007/0046724 | A1 * | 3/2007 | Jung et al. | 347/33 |

FOREIGN PATENT DOCUMENTS

| | | | |
|---|---|---|---|
| JP | 02179757 | A * | 7/1990 |
| JP | 04028609 | A * | 1/1992 |
| JP | 5-92575 | | 4/1993 |
| JP | 7-314824 | | 12/1995 |
| JP | 2008-137266 | | 6/2008 |

OTHER PUBLICATIONS

U.S. Appl. No. 12/693,738, filed Jan. 26, 2010, Yamaguchi, et al.
U.S. Appl. No. 12/693,819, filed Jan. 26, 2010, Yamaguchi, et al.

* cited by examiner

*Primary Examiner* — Shelby Fidler

(74) *Attorney, Agent, or Firm* — Oblon, Spivak, McClelland, Maier & Neustadt, L.L.P.

(57) ABSTRACT

A liquid discharge apparatus includes: nozzles that discharge liquid; a liquid discharge head including the nozzles arranged in arrays; cleaning belts formed in the shape of a Mobius strip; installation rollers around which the cleaning belts rotate; a support frame that supports the installation rollers so that an angle is formed between a width direction of the cleaning belt and an arrangement direction of the nozzles; a moving unit for moving the support frame in the arrangement direction of the nozzles; and a rotational drive unit for rotationally driving the installation rollers. The cleaning belts clean the liquid discharge head by adsorbing attached liquid via contact with the liquid discharge head.

10 Claims, 12 Drawing Sheets

LIQUID DISCHARGE APPARATUS HAVING CLEANING BELTS IN THE SHAPE OF A MOBIUS STRIP AND METHOD OF CONTROLLING THE SAME

BACKGROUND OF THE INVENTION

1. Field of the Invention

The present invention relates to a liquid discharge apparatus that can maintain a high cleaning effect when cleaning a liquid discharge head where nozzle arrays for discharging liquid are formed, and a method of controlling the liquid discharge apparatus.

2. Description of the Related Art

A liquid discharge apparatus such as an inkjet printer forms an image on a recording sheet by discharging ink from nozzle arrays that are formed at a liquid discharge head. For this reason, if an image is formed while a liquid discharge surface (a portion where the nozzle arrays are formed) of the liquid discharge head is contaminated or liquid or dirt is attached to the liquid discharge surface, printing quality deteriorates. In particular, if ink, which has a color different from the colors of existing ink (liquid), may flow back from nozzles in the case of an inkjet printer that manages full color, the color of the ink is mixed to the colors of the existing ink (liquid), so that mixed color ink is discharged during printing. As a result, image quality deteriorates.

Accordingly, in the past, various techniques, which clean a liquid discharge surface of a liquid discharge head, have been proposed in order to prevent the deterioration of printing quality. For example, a rubber blade method, which slides a slightly hard rubber blade over the liquid discharge surface while pushing the rubber blade against the liquid discharge surface, removes contaminations, standing ink, thickened or solidified ink, and the like, which are attached to the liquid discharge surface, by wiping them off. As a result, the discharge of ink is restored or discharge performance is stabilized.

However, ink, etc. attached to the liquid discharge surface is apt to remain in the rubber blade method, so that a sufficient cleaning effect may not be obtained. In particular, since a line inkjet printer includes a line head where head chips for discharging ink (liquid) are arranged side by side so as to correspond to a printing width, an ink discharge surface (liquid discharge surface) is wide. For this reason, it is difficult to uniformly push the rubber blade against the entire ink discharge surface, so that wiping is not sufficient. Further, among line heads, there is a line head where stepped portions are formed on an ink discharge surface. In the case of this kind of line head, it may not be possible to remove ink that remains at the stepped portions.

FIGS. 12A and 12B are cross-sectional views showing a state where a line head 120 is being cleaned by a rubber blade method in the related art, as seen from the side surface.

As shown in FIG. 12A, a rubber blade method makes a rubber blade 141 come into contact with an ink discharge surface 121 of a line head 120 and moves the rubber blade 141 along the ink discharge surface 121 in an arrangement direction of nozzles like an arrow, thereby wiping off standing ink and the like that are attached to the ink discharge surface 121. Therefore, it is necessary that the rubber blade 141 uniformly comes into contact with the ink discharge surface 121 without a gap.

Meanwhile, if a stepped portion is formed on the ink discharge surface 121 as shown in FIG. 12B, a gap is formed between a corner of the stepped portion and the rubber blade 141 that comes into press contact with the ink discharge surface 121 and is bent. Accordingly, the rubber blade 141 does not come into contact with the corner of the stepped portion. For this reason, it may not be possible to wipe off residual ink attached to the gap or dirt and foreign materials that are pushed to the corner of the stepped portion by the movement of the rubber blade 141.

Accordingly, there is known a wiping roller method that slides or rotationally moves not the rubber blade 141 but a cleaning roller (not shown), which is made of a foam material excellent in water adsorbability, on an ink discharge surface 121, so as to adsorb residual ink attached to the corner of the stepped portion. According to this method, the porous foam forming the cleaning roller is recessed so as to correspond to the stepped portion, so that a gap may not be formed at the corner of the stepped portion. Further, since a pore (cell) formed in the porous foam generates a capillary force, it may be possible to clean the ink discharge surface while adsorbing standing ink and the like attached to the ink discharge surface 121 by the capillary force.

However, in the wiping roller method, water of the ink, which is once adsorbed in a flexible porous foam forming the cleaning roller and held in the porous foam, is hardly evaporated. Accordingly, time is necessary for drying the porous foam. For this reason, whenever cleaning is performed, water is adsorbed in the porous foam. As a result, the porous foam is saturated with water, so that the adsorbability of the porous foam deteriorates. In addition, if the porous foam is saturated with water, ink held in the cleaning roller is transferred to the ink discharge surface 121. For this reason, there is a concern that the ink discharge surface 121 is contaminated. For this reason, in order to cope with these problems, the outer diameter of the cleaning roller should be increased or the cleaning roller should be replaced at regular intervals.

Accordingly, there is known a cleaning cloth method that uses not a cleaning roller but a tape-shaped cleaning cloth. In this method, a cleaning cloth is automatically wound around a reel while an action surface of a cleaning cloth is pressed against an ink discharge surface 121 by a plane. For this reason, it may be possible to typically wipe off the ink discharge surface 121 with a fresh portion of the cleaning cloth.

Further, there is also known a technique where an elastic roller is rotatably disposed around an axis parallel to an arrangement direction of nozzles and an endless cleaning belt is provided on the outer periphery of the roller. In this cleaning belt method, a cleaning belt for cleaning nozzles comes into press contact with the ink discharge surface 121 due to the elastic action of the roller. Further, the roller is rotationally driven by a motor and the cleaning belt positioned at a position facing the nozzles is rotated, so that it may be possible to remove contaminations from the ink discharge surface 121.

These techniques are disclosed in JP-A-11-78034 and JP-A-5-92575.

SUMMARY OF THE INVENTION

However, the cleaning cloth method performs cleaning while the planar action surface of the cleaning cloth is pressed. Accordingly, as in a rubber blade method, the cleaning cloth does not come into contact with a corner of a stepped portion of the ink discharge surface 121, so that a gap is formed. For this reason, it may not be possible to wipe off residual ink and the like that are attached to the gap, so that a sufficient cleaning effect is not obtained.

Further, since the roller is disposed parallel to the arrangement direction of nozzles in the cleaning belt in the related art, the cleaning belt method in the related art particularly causes problems in the case of a line inkjet printer including the line head 120. Specifically, a plurality of nozzles is arranged in the line head 120 for the improvement of printing speed, so that the size of the ink discharge surface 121 is increased. For this reason, the width of the cleaning belt is increased (the length of the cleaning belt is increased in the arrangement direction of the nozzles) according to the number of the arranged nozzles. As a result, the size of the inkjet printer is increased.

Thus, it is desirable to maintain a high cleaning effect and to avoid the increase in the size of a liquid discharge apparatus even in a line type.

According to one embodiment of the invention, there is provided a liquid discharge apparatus. The liquid discharge apparatus includes a plurality of nozzles that discharges liquid, a liquid discharge head that includes nozzle arrays where the respective nozzles are arranged in one direction, cleaning belts that are formed in the shape of a Mobius strip and clean a portion of the liquid discharge head where the nozzle arrays are formed by adsorbing liquid attached to the portion of the liquid discharge head, installation rollers around which the cleaning belts are rotatably installed, a support frame that supports the installation rollers so that an angle is formed between the width direction of the cleaning belt and the arrangement direction of the nozzles and the cleaning belts positioned on the peripheral surface of the installation roller come into contact with the portion of the liquid discharge head where the nozzle arrays are formed, a moving means for moving the support frame in the arrangement direction of the nozzles, and a rotational drive means for rotationally driving the installation roller.

Further, according to another embodiment of the invention, there is provided a method of controlling the liquid discharge apparatus according to the one embodiment. In the liquid discharge apparatus, the rotational drive means does not rotationally drive the installation roller while the support frame is moved by the moving means, and rotationally drives the installation roller in one direction during the stop of the support frame until contact portions of the cleaning belts, which come into contact with the portions of the liquid discharge head where the nozzle arrays are formed, are changed.

According to the embodiments of the invention, the liquid discharge apparatus includes cleaning belts that clean a portion of the liquid discharge head where the nozzle arrays are formed by adsorbing liquid attached to the portion of the liquid discharge head. The cleaning belts are rotatably installed around the installation rollers. The installation rollers are supported by the support frame so that the cleaning belts positioned on the peripheral surface of the installation roller come into contact with the portion of the liquid discharge head where the nozzle arrays are formed. The support frame is moved by the moving means. For this reason, the portion where the nozzle arrays are formed is cleaned by the movement of the contact portions of the cleaning belts positioned on the peripheral surface of the installation roller. Further, the installation roller is rotationally driven by the rotational drive means, so that the contact portions of the cleaning belts may be changed. Furthermore, since each of the cleaning belts is formed in the shape of a Mobius strip, it may be possible to use both front and back surfaces of the cleaning belts.

In addition, the installation rollers are supported by the support frame so that an angle (for example, 90°) is formed between the width direction of the cleaning belt and the arrangement direction of the nozzles. Further, the support frame is moved in the arrangement direction of the nozzles. For this reason, it is not necessary to increase the width of the cleaning belt (to increase the length of the cleaning belt in the arrangement direction of the nozzles) according to the number of the arranged nozzles.

According to the embodiments of the invention, the cleaning belts positioned on the peripheral surface of the installation roller come into contact with the portion where the nozzle arrays are formed. Accordingly, even though stepped portions are formed on the portion where the nozzle arrays are formed, the cleaning belts may be pressed against even the corners of the stepped portions by the installation roller. For this reason, it may be possible to obtain a sufficient cleaning effect so that ink and the like do not remain at the corners of the stepped portions. Further, since it may be possible to use both front and back surfaces of the Mobius strip-shaped cleaning belt, it may be possible to maintain a high cleaning effect through the change of the contact portion of the cleaning belt. Furthermore, since it is not necessary to increase the width of the cleaning belt (to increase the length of the cleaning belt in the arrangement direction of the nozzles) according to the number of the arranged nozzles, it may be possible to avoid the increase in the size of a liquid discharge apparatus even in a line type.

DESCRIPTION OF THE PREFERRED EMBODIMENTS

Embodiments of the invention will be described below with reference to the drawings.

Here, a liquid discharge apparatus of an embodiment of the invention is an inkjet printer 10, which discharges ink as liquid, in the following embodiments. Further, the inkjet printer 10 is a line inkjet printer that includes a line head 20 (which serves as a liquid discharge head in the invention) corresponding to a printing width (for example, A4 size). Furthermore, a nozzle array 32*a*, where a plurality of nozzles 32 for discharging ink is arranged in one direction at a predetermined pitch over the length of a printable maximum-size recording sheet (which corresponds to an object to which ink is discharged) in a sheet width direction, is formed at the line head 20. A portion where the nozzle array 32*a* is formed forms an ink discharge surface 21. In addition, the inkjet printer 10 manages color printing, and includes a nozzle array 32*a* for each of ink colors, such as yellow (Y), magenta (M), cyan (C), and black (K).

Configuration Example of Liquid Discharge Apparatus

Figure 1:
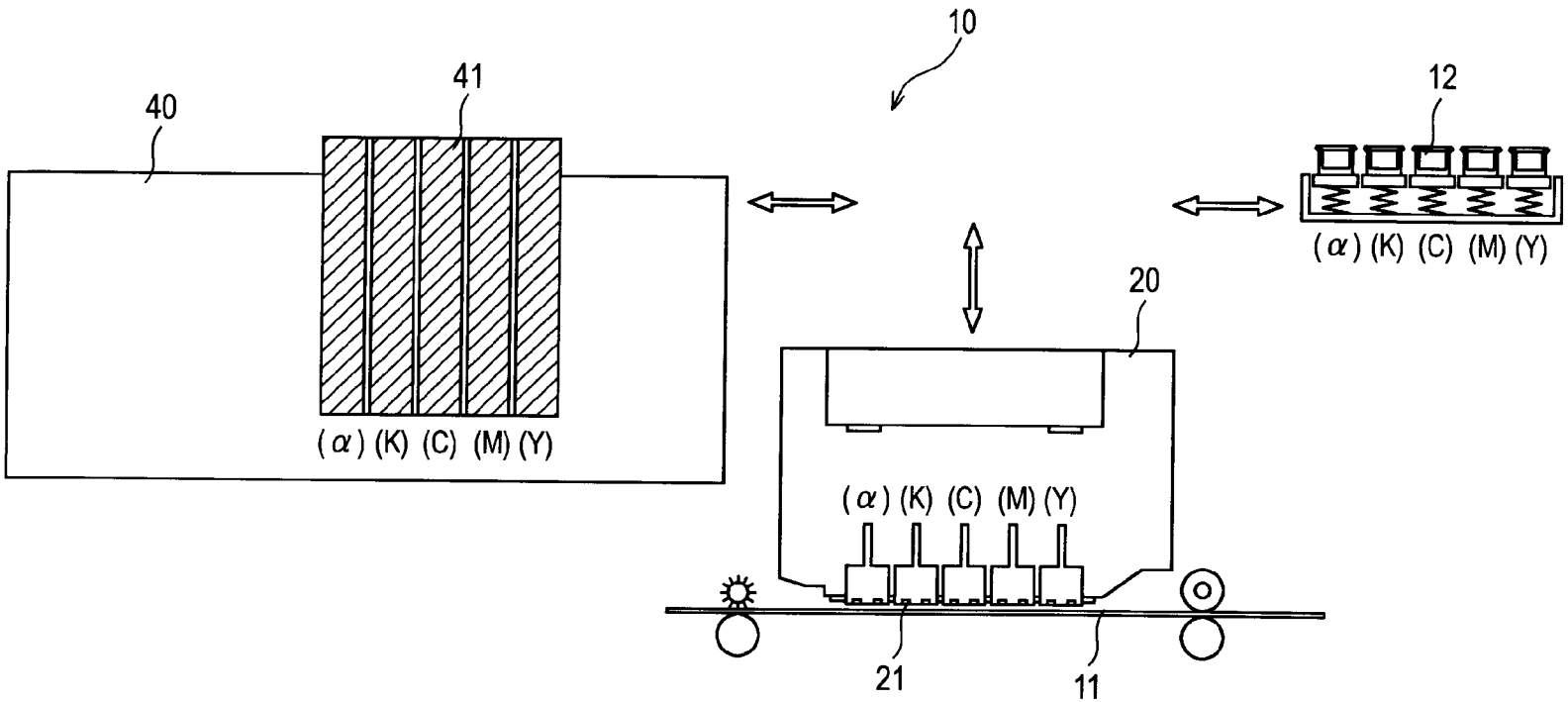
FIG. 1 is a front view showing the entire configuration of an inkjet printer as a liquid discharge apparatus according to an embodiment of the invention, and shows the state of the inkjet printer during printing.

FIG. 1 is a front view showing the entire configuration of an inkjet printer 10 as a liquid discharge apparatus according to an embodiment of the invention, and shows the state of the inkjet printer during printing.

Figure 2:
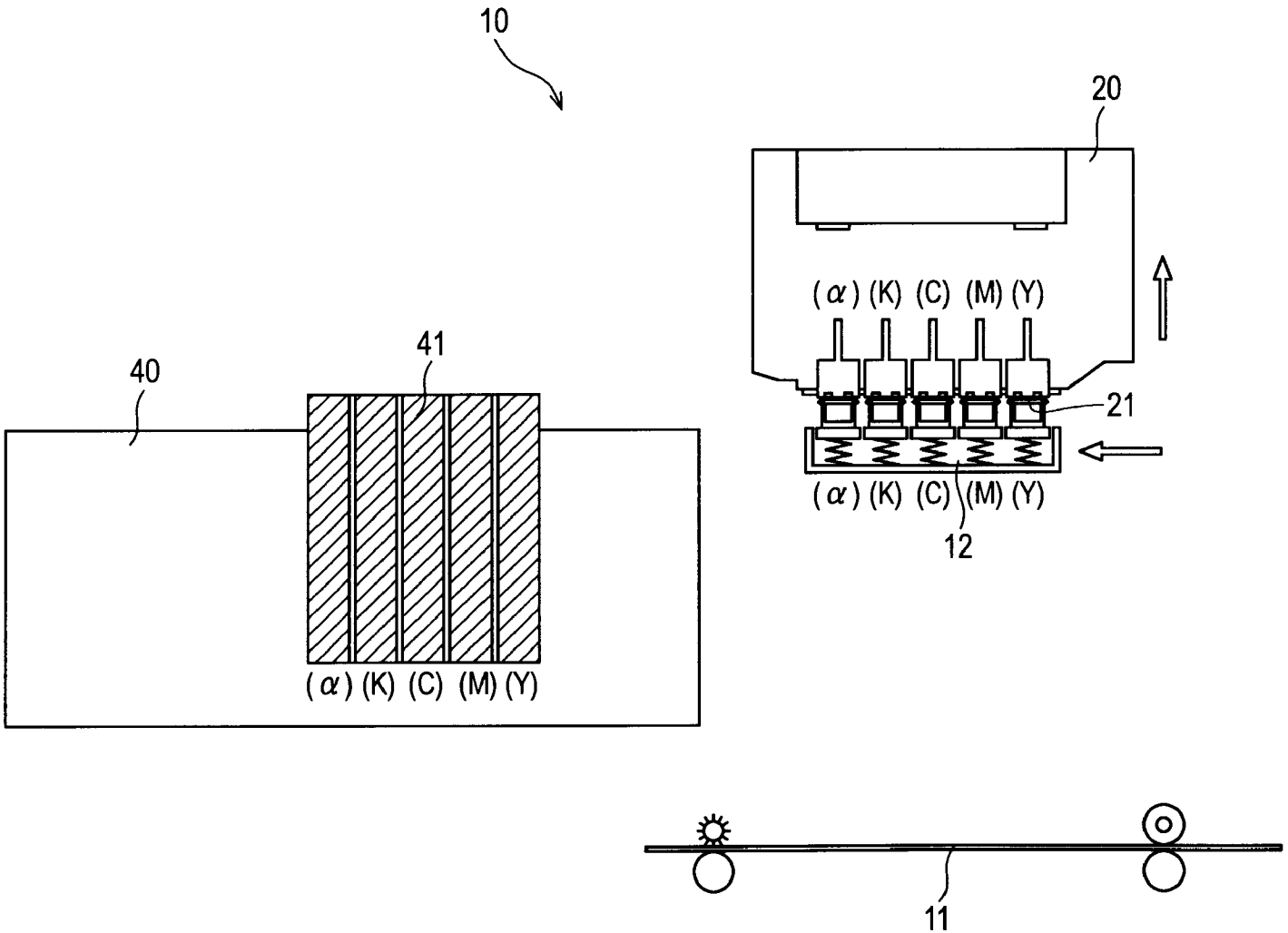
FIG. 2 is a front view showing the entire configuration of the inkjet printer as the liquid discharge apparatus according to the embodiment of the invention, and shows the state of the inkjet printer during standby.

FIG. 2 is a front view showing the entire configuration of the inkjet printer 10 as the liquid discharge apparatus according to the embodiment of the invention, and shows the state of the inkjet printer during standby.

Figure 3:
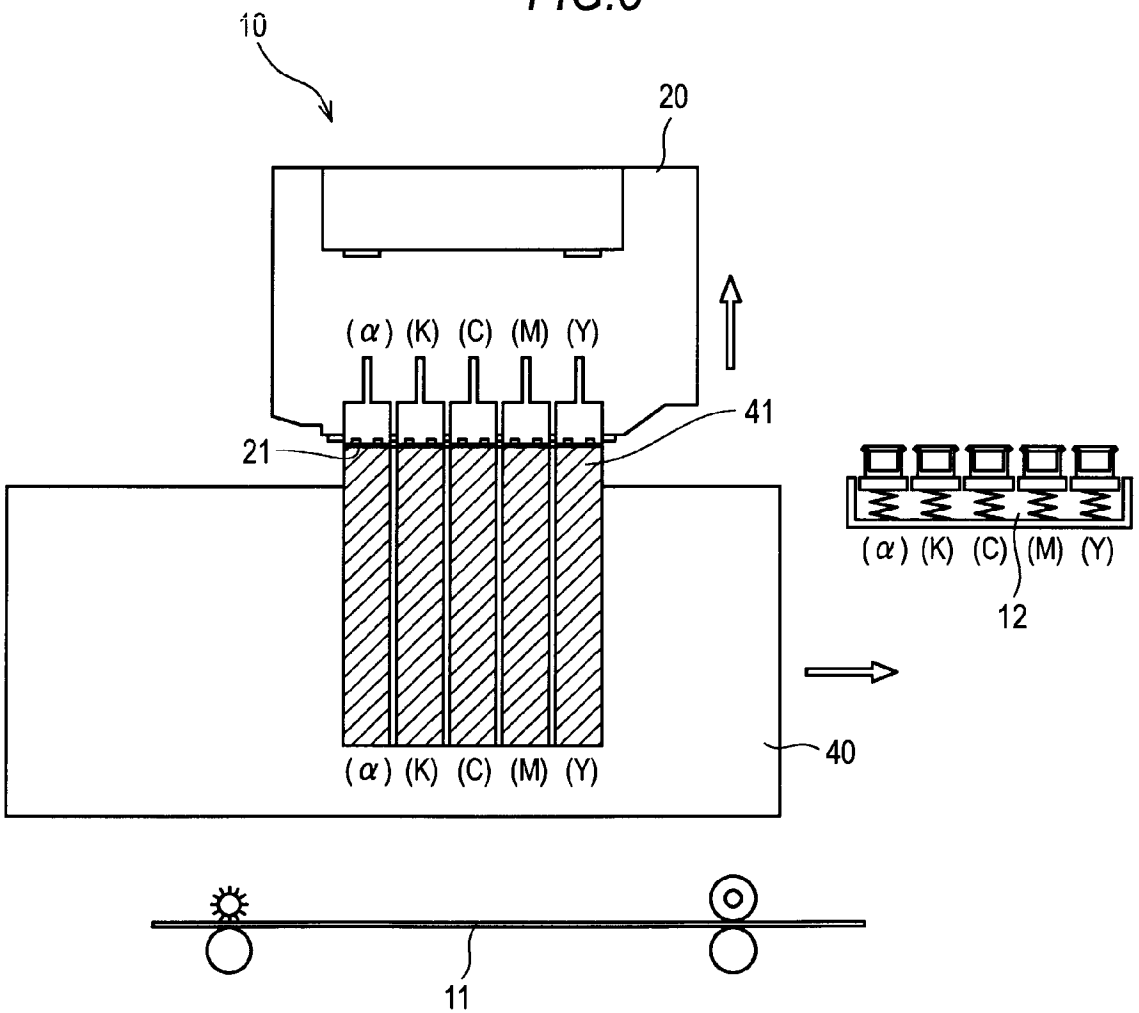
FIG. 3 is a front view showing the entire configuration of the inkjet printer as the liquid discharge apparatus according to the embodiment of the invention, and shows the state of the inkjet printer during cleaning.

FIG. 3 is a front view showing the entire configuration of the inkjet printer 10 as the liquid discharge apparatus according to the embodiment (first embodiment) of the invention, and shows the state of the inkjet printer during cleaning.

As shown in FIGS. 1 to 3, the inkjet printer 10 includes a printing table 11 that substantially horizontally supports a recording sheet conveyed from a sheet feed unit (not shown), a line head 20 that forms an image on the recording sheet by discharging ink from an ink discharge surface 21 onto the recording sheet placed on the printing table 11, a head cap 12 that protects the ink discharge surface 21 of the line head 20, and a cleaning device 40 that includes cleaning belts 41 for cleaning the ink discharge surface 21 of the line head 20. Further, the line head 20 may discharge five kinds of ink that include another liquid (α) in addition to respective color inks, such as yellow (Y), magenta (M), cyan (C), and black (K) inks. Meanwhile, the liquid (α) is moisturizing liquid or the like that prevents oil-based black or gray ink from being dried with respect to water-based black (K) ink and prevents the line head 20 from being dried.

Further, the inkjet printer 10 includes a lifting unit that lifts and lowers the line head 20 along a vertical arrow (see FIG. 1). The lifting unit may be formed of, for example, a gear, a belt, a cam, a piston to be rotationally driven, or a combination thereof. Furthermore, the line head 20 is lifted and lowered between a printing position (a position shown in FIG. 1; and a standby position (a position shown in FIG. 2) or a cleaning position (a position shown in FIG. 3) by the lifting unit. At the printing position, the ink discharge surface 21 is lowered directly above the printing table 11 by the lifting unit and an image is formed on the recording sheet. At the standby position, the line head is lifted so that the line head ink discharge surface 21 is covered with the head cap 12. The ink discharge surface 21 may be cleaned at the cleaning position. Meanwhile, the recording sheet is fed onto the printing table 11 from the sheet feed unit (not shown) and is supported substantially horizontally. Further, the recording sheet on which printing has been performed by the line head 20 is discharged to a paper tray (not shown).

In addition, the inkjet printer 10 includes a moving unit that moves the head cap 12 or the cleaning device 40 along a horizontal arrow (see FIG. 1). The moving unit may be formed of, for example, a gear, a belt, a cam, a piston to be rotationally driven, or a combination thereof. The head cap 12 is moved to enter a space formed on the printing table 11 from the right side to the left side and is positioned directly below the ink discharge surface 21 when the line head 20 is lifted and positioned at the standby position (the position shown in FIG. 2). Further, the ink discharge surface 21 is covered with the head cap 12 in a standby state where printing is not performed. Accordingly, the head cap 12 prevents ink from being dried and prevents dust or paper powder from being attached to the ink discharge surface in the standby state, so that the clogging of nozzles 32 (not shown) is prevented. Meanwhile, in order to improve sealability between the head cap 12 and the ink discharge surface 21, the head cap 12 is provided with rubber caps for the nozzle arrays of the line head 20 that correspond to the yellow (Y), magenta (M), cyan (C), and black (K) inks and the liquid (α), respectively.

Further, the cleaning device 40 includes endless cleaning belts 41 that are made of a porous foam or the like. Furthermore, while the line head 20 is positioned at the cleaning position (the position shown in FIG. 3), the cleaning device enters a space formed on the printing table 11 from the left side to the right side and is moved in order to perform cleaning so that the ink discharge surface 21 and the cleaning belts 41 face each other. After that, the cleaning device wipes off waste ink or the like attached to the ink discharge surface 21 by making the cleaning belts 41 come into contact with the ink discharge surface 21 and moving the cleaning belts in a direction perpendicular to the plane of FIG. 3, and adsorbs the waste ink or the like. Meanwhile, the cleaning belts 41 may be provided so as to correspond to nozzle arrays of the line head 20 for the yellow (Y), magenta (M), cyan (C), and black (K) inks and the liquid (α), respectively. The cleaning belt may be made of nonwoven fabric, condensed chemical fiber, or the like other than the porous foam.

Configuration Example of Liquid Discharge Head

Figure 4:
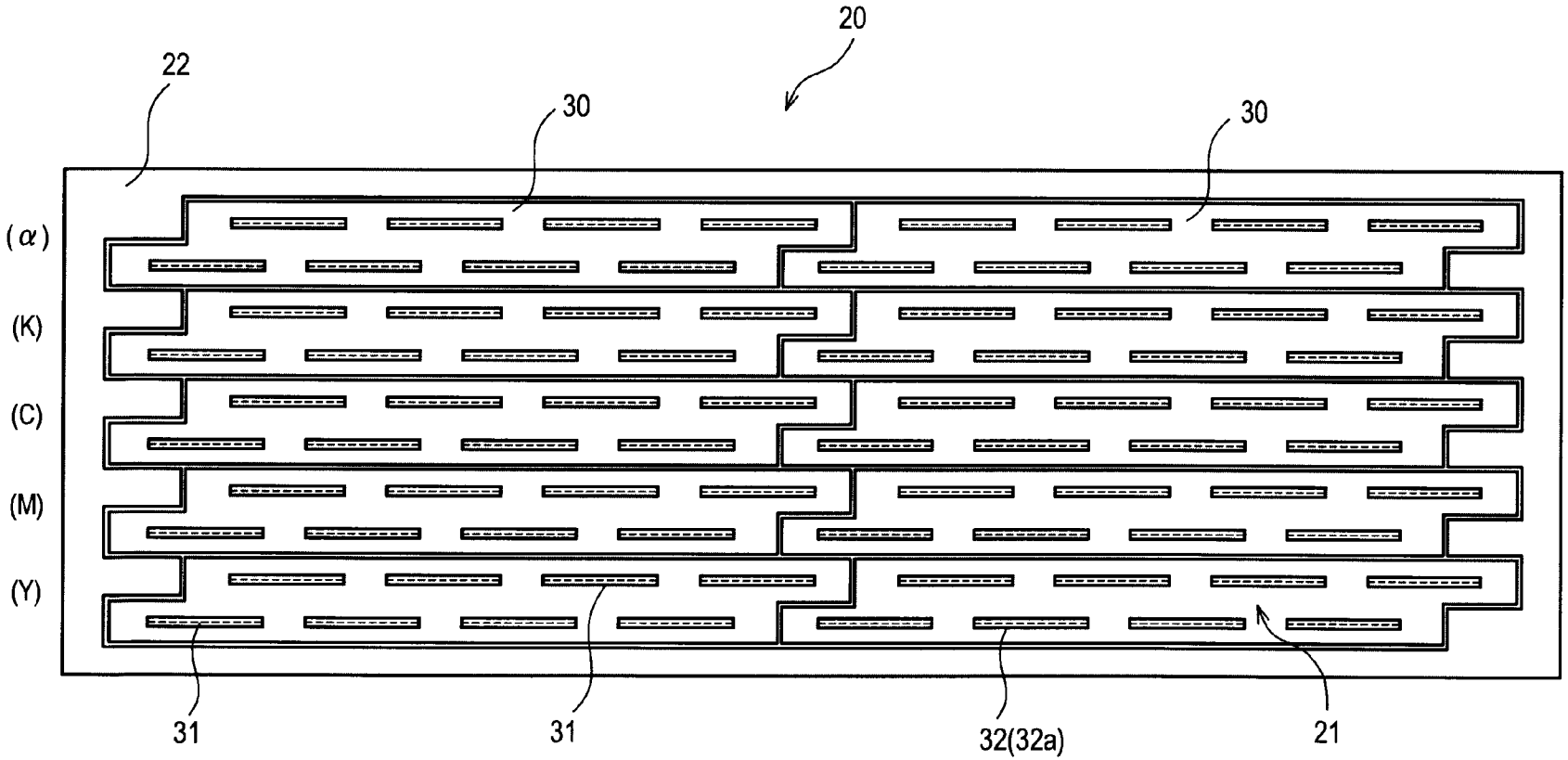
FIG. 4 is a plan view of a line head of the inkjet printer shown in FIGS. 1 to 3, and is a view as seen from an ink discharge surface.

FIG. 4 is a plan view of the line head 20 of the inkjet printer 10 shown in FIGS. 1 to 3, and is a view as seen from the ink discharge surface 21.

As shown in FIG. 4, the line head 20 includes a head frame 22 and a plurality of head modules 30 that is held by the head frame 22. Specifically, two head modules 30 are connected in series in the longitudinal direction of the head frame 22 (the sheet width direction), and are inserted into the head frame 22. Further, the two head modules 30 cover the width of a printable maximum-size recording sheet (for example, the width of an A4 sheet), and print the recording sheet with one color. Furthermore, five lines, each of which is formed by the two head modules 30 connected in series, (total ten head modules) are provided parallel to each other, and form a full-color image by discharging Y (yellow), M (magenta), C (cyan), and K (black) inks and the liquid (α), respectively.

In addition, each of the head modules 30 is provided with a plurality of head chips 31. Specifically, eight head chips 31 are disposed in zigzags in the form of a 4-by-2 matrix in each of the head modules 30. Further, in each of the head chips 31, a plurality of nozzles 32 for discharging ink is arranged in one direction so as to form a nozzle array 32*a*. For this reason, nozzle arrays 32*a* are disposed in two lines in each of the head modules 30 so as to be parallel to each other, the respective nozzles 32 are arranged along the length of the recording sheet in the width direction of the sheet, and nozzle arrays are disposed in ten lines so as to be parallel in the entire line head 20. A portion of the line head where the nozzle arrays 32*a* are formed (a surface of the line head where the nozzle arrays 32*a* are formed) forms the ink discharge surface 21. Meanwhile, a distance between the nozzles 32 is the same in all of the head chips that are adjacent to each other in zigzags.

Figure 5:
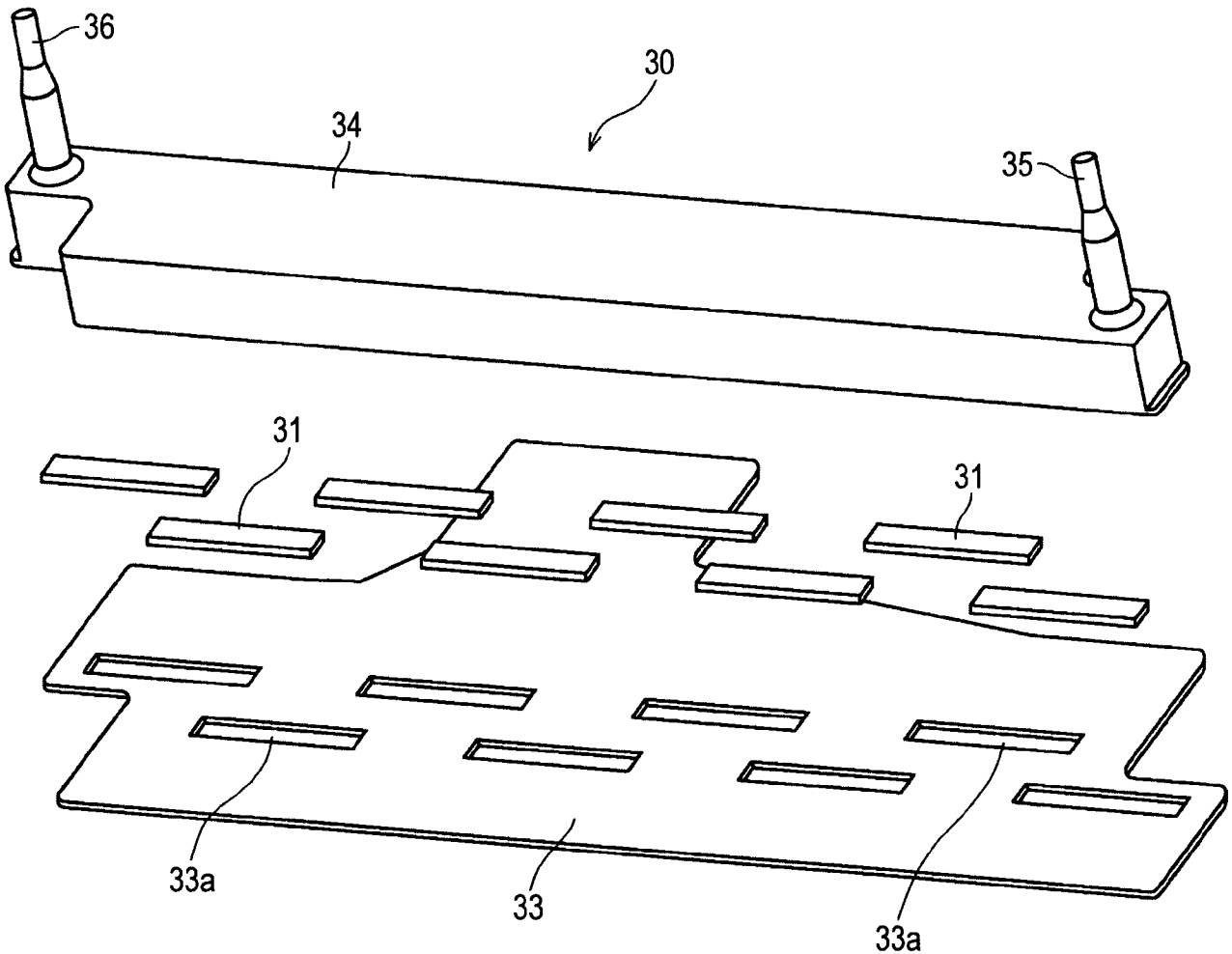
FIG. 5 is an exploded perspective view of each head module of the line head shown in FIG. 4.

FIG. 5 is an exploded perspective view of each head module 30 of the line head 20 shown in FIG. 4.

As shown in FIG. 5, the head module 30 includes eight head chips 31, a flexible sheet 33 on which the respective head chips 31 are disposed, and an ink tank 34. Meanwhile, the ink discharge surface 21 shown in FIG. 4 is the lower surface of the flexible sheet 33 shown in FIG. 5.

Here, the flexible sheet 33 is a flexible wiring board that electrically connects the head chip 31 to a control board (not shown), and is made of polyimide and has a thickness of about 50 μm. Further, openings 33*a* are formed in zigzags at the flexible sheet 33. Furthermore, each of the head chips 31 is connected to the flexible sheet 33 so that all the nozzles 32 (see FIG. 4) are positioned in the opening 33*a* and the head chip 31 closes the opening 33*a*.

Moreover, the ink tank 34 is bonded onto the flexible sheet 33 so as to cover the respective head chips 31. The ink tank 34 forms a common flow passage through which ink is supplied to the respective head chips 31. Further, the ink tank includes an ink supply port 35 which is connected to an ink cartridge (not shown) and through which ink is supplied to the common flow passage, and an ink discharge port 36 through which ink in the common flow passage is discharged. For this reason, the ink stored in the cartridge flows in the common flow passage of the ink tank 34 through the ink supply port 35, and is supplied to the respective head chips 31. Meanwhile, when the head module 30 is inserted into the head frame 22 (see FIG. 4), a portion of the flexible sheet 33 protruding from the head module 30 is bent along the side surface of the ink tank 34.

Figure 6A:
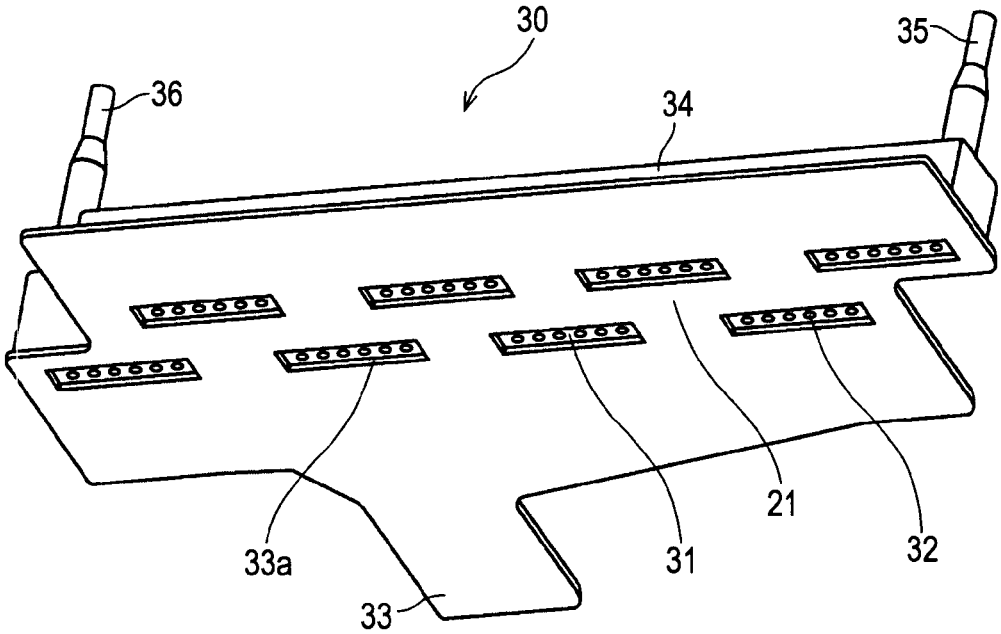
FIG. 6A is a perspective view of the head module shown in FIG. 5 as seen from the ink discharge surface.
Figure 6B:
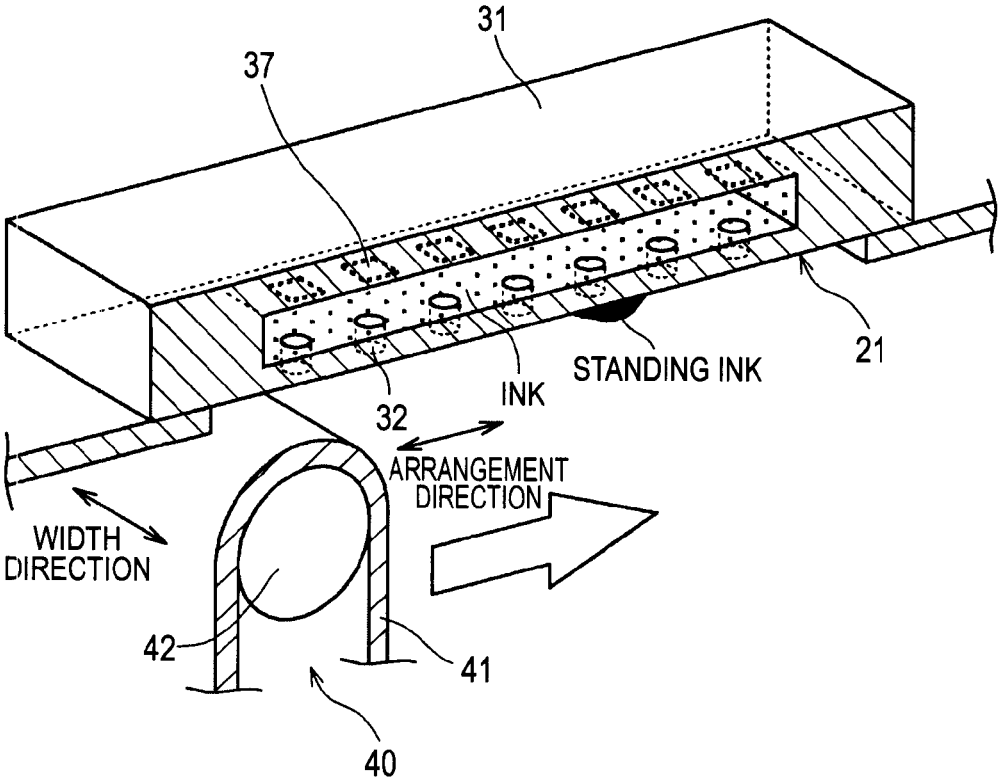
FIG. 6B is a cross-sectional view of a peripheral portion of each head chip.

FIG. 6A is a perspective view of the head module 30 shown in FIG. 5 as seen from the ink discharge surface 21, and FIG. 6B is a cross-sectional view of a peripheral portion of each head chip 31.

As shown in FIG. 6A, the head module 30 is formed by disposing eight head chips 31 in zigzags in an internal space between the flexible sheet 33 and the ink tank 34. Further, all the nozzles 32 of each of the head chips 31 are positioned in the opening 33*a* of the flexible sheet 33. For this reason, the ink discharge surface 21 is formed of the surface of the flexible sheet 33 except for the openings 33*a* and surfaces of the head chips 31 positioned in the openings 33*a*.

Furthermore, as shown in FIG. 6B, the head chip 31 includes a plurality of heating resistors 37 that is arranged at positions facing the respective nozzles 32, and a space between each of the nozzles 32 and each of the heating resistors 37 forms a liquid chamber for ink. Further, when ink is supplied from the ink supply port 35 (see FIG. 6A), not only spaces around the head chips 31 but also the liquid chambers of the head chips 31 are filled with ink.

Here, when pulse current flows in the heating resistor 37 through the flexible sheet 33 (see FIG. 6A) in a short time (for example, 1 to 3 microseconds) by a command sent from the control board (not shown), the heating resistor 37 is rapidly heated. For this reason, bubbles of ink are generated (ink is boiled) at a portion coming into contact with the heating resistor 37, and ink having a predetermined volume is pushed by the expansion of the bubbles. As a result, this becomes discharge pressure, and ink having the same volume as the volume of the pushed ink is discharged from the nozzle 32.

As described above, the head chip 31 discharges ink from the nozzles 32 by heating the heating resistor 37, and forms an image on the recording sheet that is fed directly below the nozzles 32. For this reason, while ink is repeatedly discharged, standing ink may be generated on the ink discharge surface 21 or dirt or foreign materials may be attached to the ink discharge surface. Further, if this state is left out, the discharge of ink from the nozzle 32 is hindered, which causes discharge failure, such as nondischarge or incomplete discharge.

Furthermore, standing ink corresponding to different colors is also attached to the ink discharge surface 21 in the line head 20 (see FIG. 4) that manages full color. For this reason, the standing ink, which has a color different from the colors of existing ink stored in the head module 30, may flow back from the nozzles 32. In addition, the color of the standing ink is mixed to the colors of the existing ink, so that mixed color ink is discharged. Therefore, the deterioration of image quality, such as change in concentration, deviation in hue, and stripe unevenness, is caused.

Accordingly, the cleaning device 40 shown in FIG. 6B is provided to wipe off the standing ink and the like from the ink discharge surface 21. The cleaning device 40 includes endless cleaning belts 41 and installation rollers 42 where the cleaning belts 41 are rotatably installed. Each of the cleaning belts 41 is provided so that an angle (90° in this embodiment) is formed between the width direction of the cleaning belt and the arrangement direction of the nozzles 32. Further, the cleaning belts 41, which are positioned on the peripheral surface of the installation roller 42, come into contact with the ink discharge surface 21. Furthermore, the cleaning belts 41 are provided so as to correspond to the nozzle arrays 32*a* of the line head 20 shown in FIG. 4 for the yellow (Y), magenta (M), cyan (C), and black (K) inks and the liquid (α), respectively. Accordingly, the respective cleaning belts 41 individually wipe off the peripheral portions of the respective nozzle arrays 32*a* that form five lines on the ink discharge surface 21.

The respective cleaning belts 41 of the cleaning device 40 are moved in the arrangement direction of the nozzles 32 by a moving unit that moves the cleaning belts 41 along an arrow that is obliquely inclined toward the right upper side in FIG. 6B. Accordingly, the cleaning belts wipe off the standing ink and the like that are attached to the ink discharge surface 21. Meanwhile, the cleaning belts 41 are rotatably installed around the installation rollers 42, but are not rotated while being moved.

Here, the ink discharge surface 21 of the line inkjet printer including the line head 20 (see FIG. 4) is very much larger than that of a serial inkjet printer that performs printing while moving a head. For this reason, a cleaning range is large and the amount of ink to be sucked is increased in the case of the line inkjet printer. Therefore, there is a problem in the reverse transfer of ink to the ink discharge surface 21. Specifically, although standing ink and the like of the ink discharge surface 21 are adsorbed well at a cleaning start position, adsorbability is decreased as a position approaches a cleaning end position. As a result, a portion of the ink discharge surface 21, which is to be cleaned later, is typically contaminated. Accordingly, there is a high possibility that positions where the discharge failure of ink is caused may be concentrated on the portion of the ink discharge surface to be cleaned later. In this embodiment, a porous foam (cleaning belts 41) of which the ink adsorption capacity is larger than the ink adsorption capacity of a roller-shaped porous foam (cleaning roller) is formed in the shape of a Mobius strip and used in order to prevent this problem.

Figure 7A:
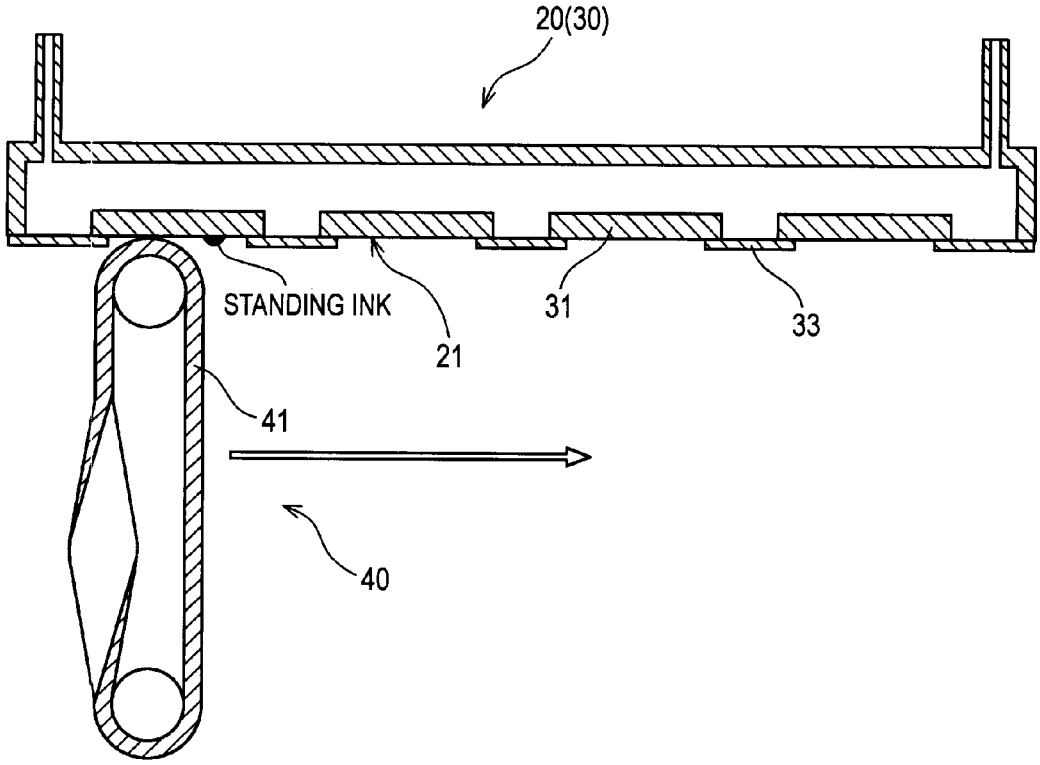
FIGS. 7A and 7B are cross-sectional views showing a state where the ink discharge surface of the line head shown in FIG. 4 is being cleaned, as seen from the side surface.
Figure 7B:
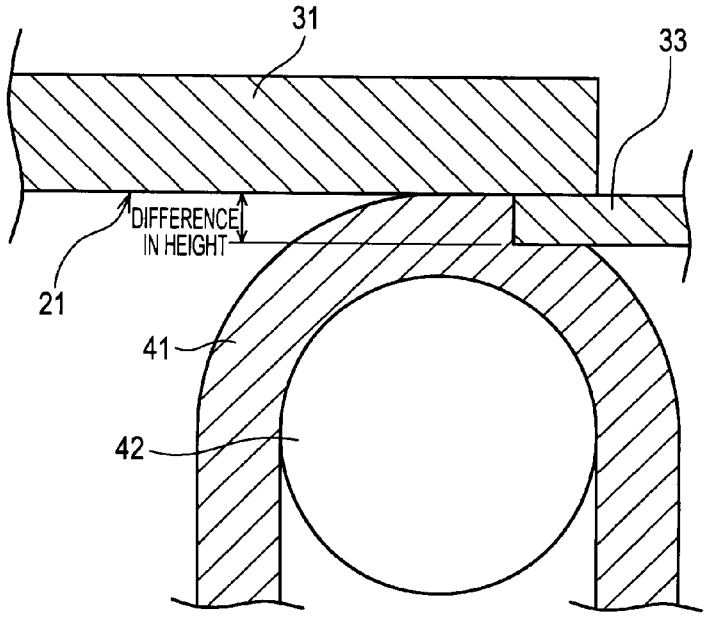

FIGS. 7A and 7B are cross-sectional views showing a state where the ink discharge surface 21 of the line head 20 shown in FIG. 4 is being cleaned, as seen from the side surface.

As shown in FIG. 7A, each of the cleaning belts 41 is formed in the shape of a Mobius strip. The Mobius strip is a figure (curved surface) that is formed by twisting one end of a rectangular strip by 180° and bonding the twisted one end to the other end of the rectangular strip, and may make the area of the used surface of a strip be typically double. Further, the cleaning belts 41, which are installed in the shape of a Mobius strip, slide on the ink discharge surface 21 in a direction of an arrow. Accordingly, standing ink, dirt, foreign materials, and the like, which are attached to the ink discharge surface 21, are wiped off by the movement of the cleaning belts 41 like a wiper. Meanwhile, the twist direction of the Mobius strip may be a clockwise direction or a counterclockwise direction.

Here, as shown in FIG. 7B, a stepped portion (a stepped portion having a difference in height of about 50 μm in this embodiment) between the head chip 31 and the flexible sheet 33 is formed on the ink discharge surface 21. However, the cleaning belt 41 is made of an open cell porous foam that has flexibility, water adsorbability, and air permeability. Accordingly, a portion positioned on the peripheral surface of the installation roller 42 follows the stepped portion. For this reason, a gap is not formed at a corner of the stepped portion, and it may be possible to almost completely adsorb residual ink and the like existing at the corner of the stepped portion by a synergistic effect of this and a capillary force of a pore (cell) formed in the porous foam.

Further, even when the number of head modules 30, which are connected in series, is increased in order to increase the width of a printable recording sheet (for example, in order to increase the width of an A4 sheet to the width of an A3 sheet), it is not necessary to change the width of the cleaning belts 41 of the cleaning device 40 of this embodiment. In other words, even though the width of the recording sheet is increased, it may be possible to clean the line head by increasing the moving distance of the cleaning belt without changing the width of the cleaning belts 41. For this reason, it may be possible to avoid the increase in the size of the cleaning device 40.

Furthermore, the endless cleaning belts 41 may be rotated by a rotational drive unit that rotationally drives the installation roller 42. For this reason, a contact portion of each of the cleaning belts 41, which comes into contact with the ink discharge surface 21 and is contaminated by the wiping-off, may be changed by the rotational drive of the installation roller 42. In addition, since each of the cleaning belts 41 is formed in the shape of a Mobius strip, it may be possible to use both front and back surfaces of the cleaning belts 41 to perform cleaning. Accordingly, it may be possible to efficiently use fresh portions of the cleaning belts 41, which are not contaminated, at the time of the next cleaning.

Figure 8:
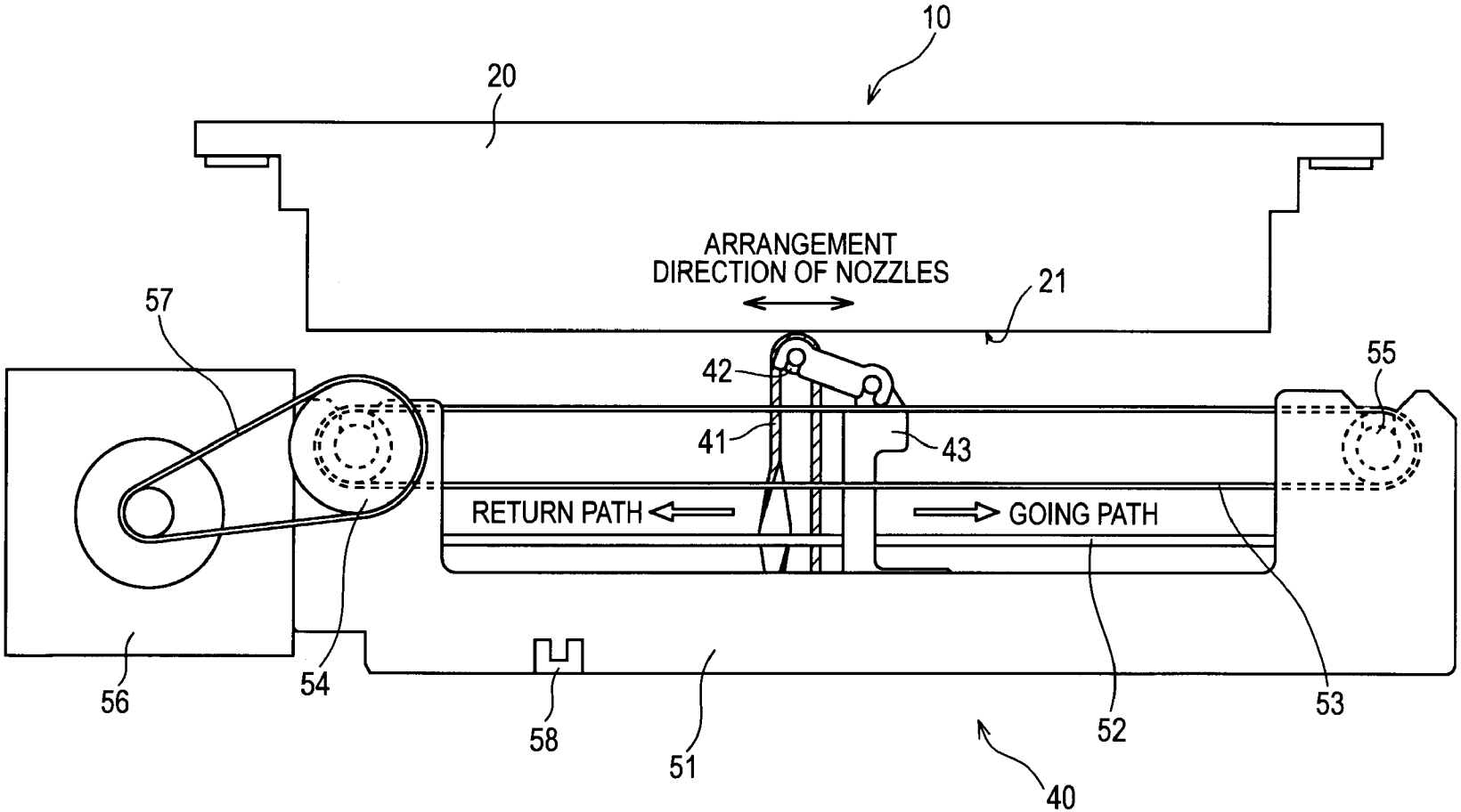
FIG. 8 is a side view of a cleaning device of the inkjet printer as the liquid discharge apparatus according to the embodiment of the invention.

FIG. 8 is a side view of the cleaning device 40 of the inkjet printer 10 as the liquid discharge apparatus according to the embodiment of the invention.

In order to clean the ink discharge surface 21 of the line head 20, the Mobius strip-shaped cleaning belts 41 are installed so as to be rotated by the installation rollers 42 as shown in FIG. 8. Further, the installation rollers 42 are supported by a belt frame 43 (which serves as a support frame in the invention). Furthermore, the cleaning belts 41 are provided in the belt frame 43 so that an angle (90° in this embodiment) is formed between the width direction of the cleaning belt 41 and the arrangement direction of the nozzles. In addition, the belt frame 43 is reciprocated in the arrangement direction of the nozzles by a moving unit that moves the belt frame 43 along a horizontal arrow shown in FIG. 8. Meanwhile, in FIG. 8, a right direction corresponds to a going path and a left direction corresponds to a return path. However, a right direction may correspond to a return path and a left direction may correspond to a going path.

The moving unit for the belt frame 43 may be formed of, for example, a gear, a belt, a cam, a piston to be rotationally driven, or a combination thereof. Further, in this embodiment, the moving unit for the belt frame 43 includes a belt driving motor 56, a movement transmitting belt 57, guide shafts 52, a moving drive belt 53, a moving drive pulley 54, and a tension pulley 55 that are provided in a base frame 51.

Here, the belt frame 43 is formed by the combination of a support made of a resin and a frame made of a metal sheet. Two guide shafts 52, which are provided in parallel to the longitudinal direction of the base frame 51, are inserted into the support. For this reason, the belt frame 43 is movable in the longitudinal direction of the base frame 51 while being supported by the guide shafts 52. Further, the moving drive belt 53 is fixed to the support of the belt frame 43. Furthermore, the moving drive belt 53 is installed parallel to the guide shafts 52 between the moving drive pulley 54 that is provided at one end of the base frame 51 and the tension pulley 55 that is provided at the other end of the base frame.

The moving drive pulley 54 is rotationally driven through the movement transmitting belt 57 by the belt driving motor 56. For this reason, when the belt driving motor 56 is driven in a normal or reverse direction, the moving drive pulley 54 is also rotated in the normal or reverse direction and may rotate the moving drive belt 53. Accordingly, as the belt driving motor 56 is driven in the normal or reverse direction, the belt frame 43 is reciprocated along the guide shafts 52 at a speed that corresponds to the rotation speed of the moving drive belt 53. Further, cleaning is completed by one reciprocating motion, and a home position (reference position) of the belt frame 43 is detected by a position sensor 58 that is provided on the base frame 51.

Figure 9:
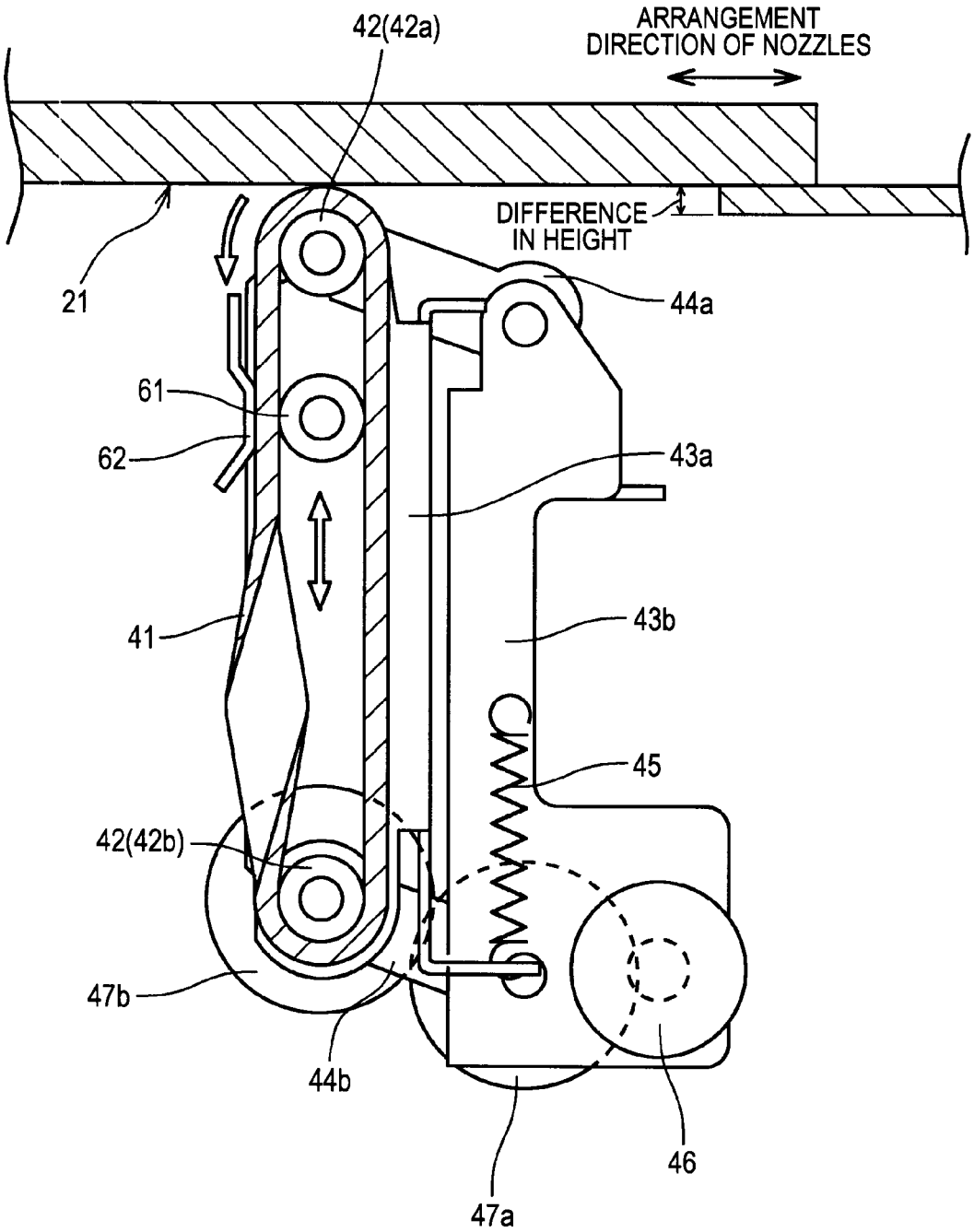
FIG. 9 is a side view of peripheral portions of cleaning belts of the cleaning device shown in FIG. 8.

FIG. 9 is a side view of peripheral portions of the cleaning belts 41 of the cleaning device 40 shown in FIG. 8.

Figure 10:
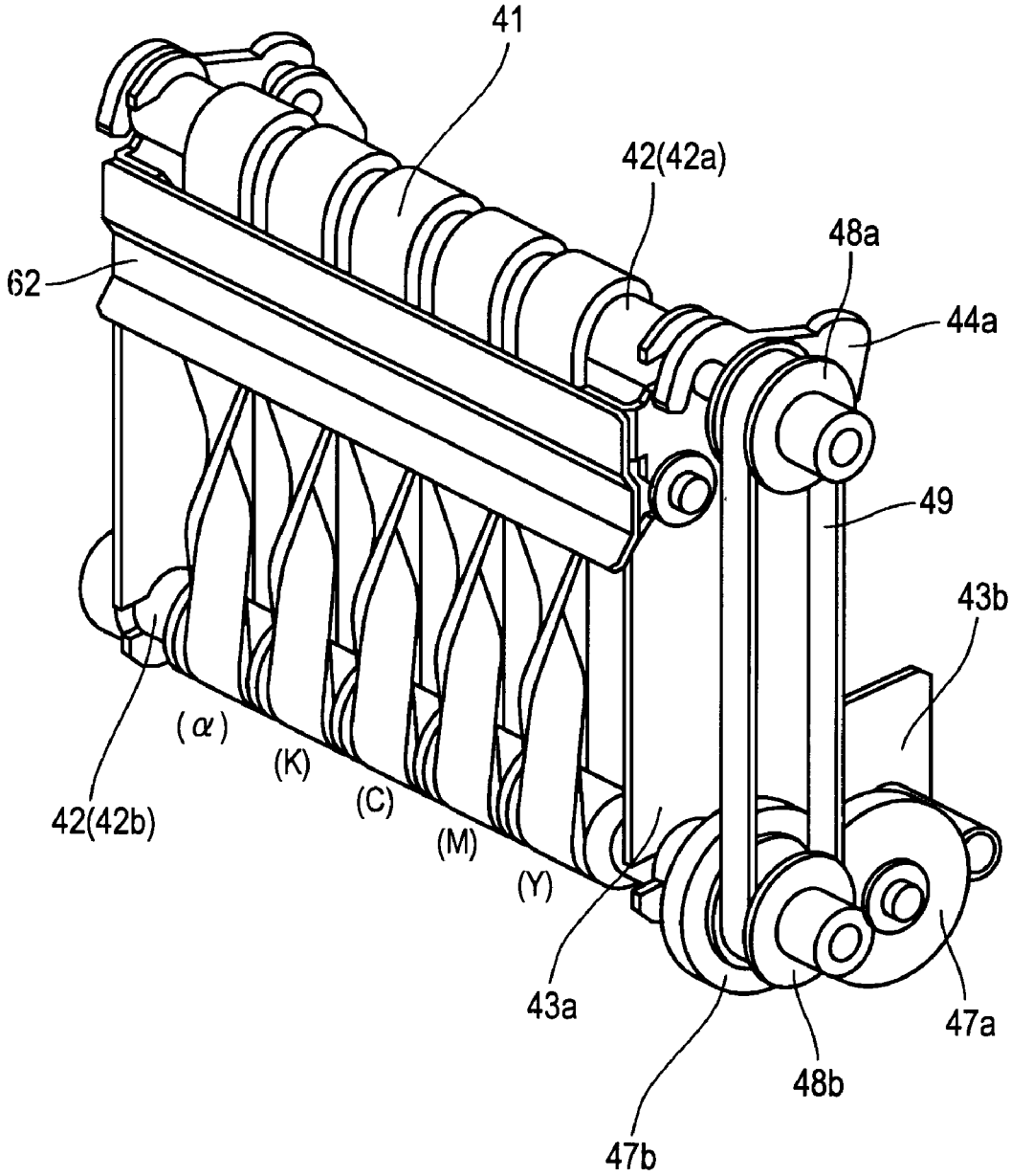
FIG. 10 is a perspective view of the peripheral portions of the cleaning belts of the cleaning device shown in FIG. 8.

Further, FIG. 10 is a perspective view of the peripheral portions of the cleaning belts 41 of the cleaning device 40 shown in FIG. 8.

As shown in FIGS. 9 and 10, each of the cleaning belts 41 is formed in the shape of a Mobius strip, and is installed so that an appropriate tension is applied to the cleaning belt by a pair of installation rollers 42 (installation rollers 42*a* and 42*b*). Further, each of the endless cleaning belts 41 is made of an open cell porous foam that has flexibility, water adsorbability, and air permeability. For this reason, even though standing ink and the like are attached to the ink discharge surface 21, it may be possible to adsorb standing ink and the like by the cleaning belts 41.

Moreover, as shown in FIG. 9, the installation rollers 42*a* and 42*b* are supported by the belt frame 43*a* and 43*b* through upper and lower links 44*a* and 44*b*, so that a four-node link mechanism is formed. For this reason, the cleaning belts 41, which are installed between the installation rollers 42*a* and 42*b*, may be moved up and down parallel to the belt frames 43*a* and 43*b* along the vertical arrow. Furthermore, the belt frame 43*a* is pushed upward by a push-up spring 45 so that portions of the cleaning belts 41, which are positioned on the peripheral surface of the upper installation roller 42*a*, come into contact with the ink discharge surface 21 at a predetermined pressure. Accordingly, even though stepped portions are formed on the ink discharge surface 21, the belt frame 43*a* (the installation rollers 42*a* and 42*b*) are moved up and down along a vertical arrow. Therefore, the cleaning belts 41 follow the stepped portions of the ink discharge surface 21.

In addition, the cleaning belts 41 may be rotated along a counterclockwise arrow shown by a rotational drive unit that rotationally drives the lower installation rollers 42*a* and 42*b*. The rotational drive unit may be formed of, for example, a gear, a belt, a cam, a piston to be rotationally driven, or a combination thereof. Further, as shown in FIGS. 9 and 10, the rotational drive unit of this embodiment includes a belt rotating motor 46, rotation transmitting gears 47*a* and 47*b*, rotation transmitting pulleys 48*a* and 48*b*, and a rotation transmitting belt 49.

Here, when the belt rotating motor 46 is rotationally driven, the rotation transmitting gears 47*a* and 47*b* are rotated in accordance with the rotational drive of the belt rotating motor. Accordingly, the installation roller 42*b* and the rotation transmitting pulley 48*b*, which are directly connected to the rotation transmitting gear 47*b*, are also rotated. Further, the torque of the rotation transmitting pulley 48*b* is transmitted to the rotation transmitting pulley 48*a* by the rotation transmitting belt 49. As a result, the installation roller 42*a* directly connected to the rotation transmitting pulley 48*a* is also rotated. Accordingly, since the cleaning belts 41 are rotated with the drive of the belt rotating motor 46, it may be possible to rotate the cleaning belts 41 at a desired timing by a desired angle by controlling the belt rotating motor 46. Meanwhile, the cleaning belts 41 may be rotated while coming into contact with the ink discharge surface 21 (see FIG. 9). However, in this embodiment, the cleaning belts are rotated while being separated from the ink discharge surface 21.

Further, an intermediate roller 61, which is disposed parallel to the installation rollers 42, is provided inside the cleaning belts 41 as shown in FIG. 9. Furthermore, a twist pressing guide 62, which guides the cleaning belts 41 so as to press the cleaning belts 41 against the intermediate roller 61, is provided outside the cleaning belts 41. Moreover, a twist pressing part, which eliminates the twist of the Mobius strip-shaped cleaning belts 41, is formed of the intermediate roller 61 and the twist pressing guide 62.

The twist pressing part (the intermediate roller 61 and the twist pressing guide 62) is disposed on the linear portions of the rotating cleaning belts 41. Further, the intermediate roller 61 and the twist pressing guide 62 are disposed with a distance, which is slightly larger than the thickness of the cleaning belt 41, therebetween on the front and rear surfaces of the cleaning belt 41. For this reason, the ends of the twisted portions of the Mobius strip-shaped cleaning belts 41 are pressed and held, so that the twist is eliminated. As a result, the twist of the cleaning belts 41 is regulated by the twist pressing part, so that the shape of each of the cleaning belts is changed into a linear shape. Therefore, the twist of each of the cleaning belts does not reach the ink discharge surface 21. Meanwhile, the intermediate roller 61 and the twist pressing guide 62 are an example of the twist pressing part, and the twist pressing part may have another structure.

As described above, the twist of each of the Mobius strip-shaped cleaning belts 41 is eliminated by the intermediate roller 61 and the twist pressing guide 62. Further, while coming into contact with the ink discharge surface 21 at a position on the peripheral surface of the installation roller 42*a*, the cleaning belts 41 are moved in the arrangement direction of the nozzles. For this reason, standing ink and the like are wiped off from the ink discharge surface 21.

Furthermore, if the cleaning belts 41 are rotated by the belt rotating motor 46, the contact portions of the cleaning belts 41, which come into contact with the ink discharge surface 21 and are contaminated by the wiping-off, may be changed by the rotation of the cleaning belts 41. Accordingly, if the cleaning belts are rotated at an appropriate timing, it may be possible to clean the ink discharge surface again by using fresh portions of both front and back surfaces of the cleaning belts 41.

In addition, as shown in FIG. 10, the cleaning belts 41 are provided in parallel so as to correspond to the nozzle arrays for the yellow (Y), magenta (M), cyan (C), and black (K) inks and the liquid ($\alpha$), respectively. Accordingly, the kind of ink, which is adsorbed in each of the cleaning belts 41 due to the wiping-off, is limited. For this reason, the contamination caused by the mixing of colors is prevented, so that it may be possible to obtain a good cleaning effect.

Figure 11:
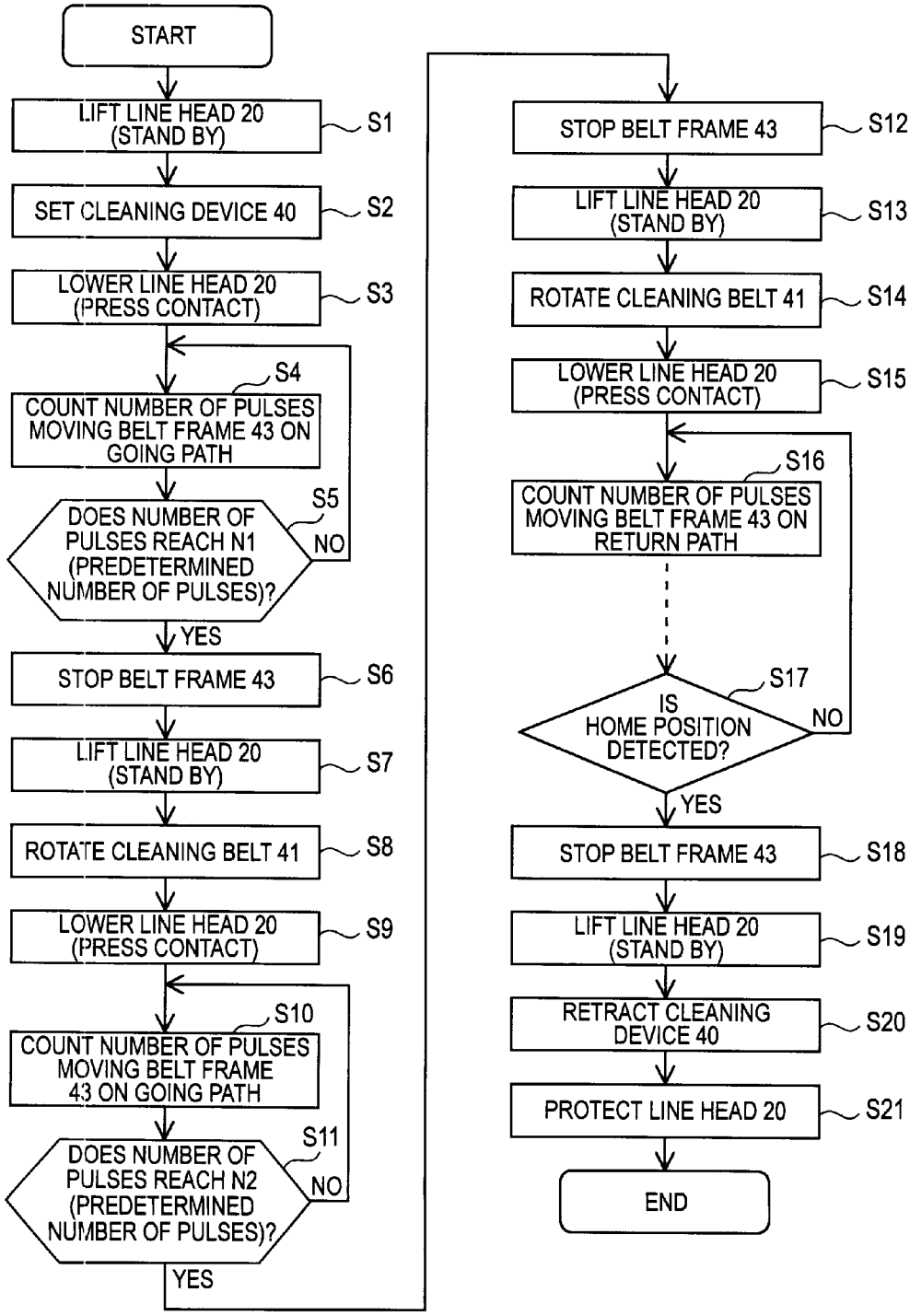
FIG. 11 is a flowchart illustrating a method of controlling the inkjet printer as the liquid discharge apparatus according to the embodiment of the invention.
Figure 12A:
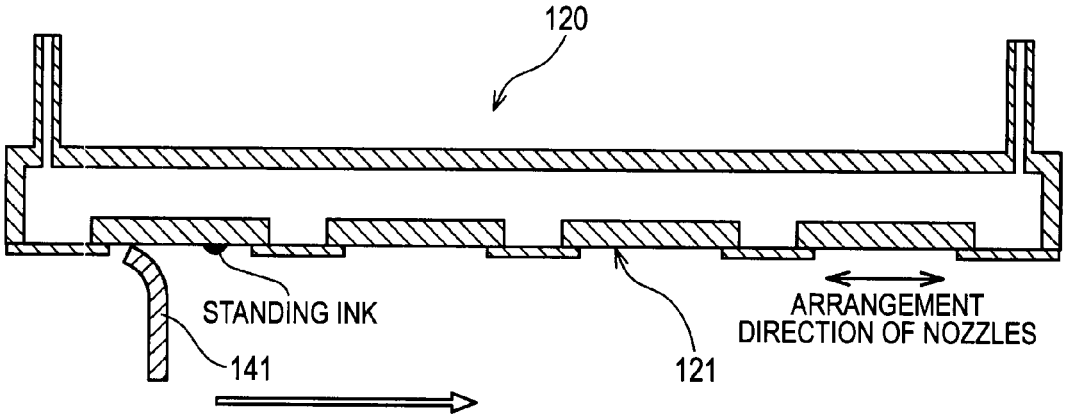
FIGS. 12A and 12B are cross-sectional views showing a state where a line head is being cleaned by a rubber blade method in the related art, as seen from the side surface.
Figure 12B:
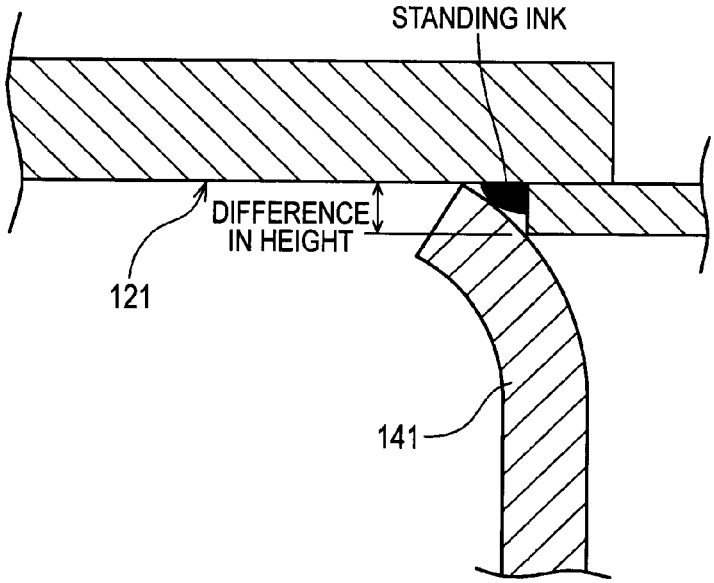

FIG. 11 is a flowchart illustrating a method of controlling the inkjet printer 10 (see FIG. 8) as the liquid discharge apparatus according to the embodiment of the invention.

The inkjet printer 10 according to this embodiment automatically executes a cleaning/maintenance program after a series of printing processes is completed. Further, after the start of the program, the line head 20 having been positioned at the position shown in FIG. 1 is lifted and stands by in the first Step S1.

After that, in Step S2, the cleaning device 40 is set between the lifted line head 20 and the table 11. Specifically, the cleaning device 40, which is separated from the line head 20 and positioned at the retract position, is moved to the right side along the arrow shown in FIG. 1. Then, the cleaning device 40 is positioned directly below the lifted line head 20. Further, the cleaning belts 41 corresponding to the nozzle arrays for the yellow (Y), magenta (M), cyan (C), and black (K) inks and the liquid ($\alpha$) face the nozzle arrays of the line head 20 corresponding to yellow (Y), magenta (M), cyan (C), and black (K) inks and the liquid ($\alpha$), respectively. Meanwhile, the movement of the line head 20 in the vertical direction is independent of the movement of the cleaning device 40 in the horizontal direction.

Subsequently, in Step S3, the line head 20 is lowered so that the ink discharge surface 21 and the cleaning belts 41 come into press contact with each other as shown in FIG. 3. Further, the press contact force is appropriately adjusted by the push-up spring 45 (see FIG. 9). Accordingly, each of the cleaning belts 41 corresponding to the nozzle arrays for the yellow (Y), magenta (M), cyan (C), and black (K) inks and the liquid ($\alpha$) individually come into contact with the nozzle arrays of the line head 20 corresponding to yellow (Y), magenta (M), cyan (C), and black (K) inks and the liquid ($\alpha$), respectively.

Furthermore, in Step S4, the belt frame 43 positioned at the home position (the cleaning start position close to the moving drive pulley 54) is moved along the going path by the rotational drive of the belt driving motor 56 (see FIG. 8). Moreover, the number of pulses, which rotationally drive the belt driving motor 56, is counted from the home position as reference. Meanwhile, the home position is detected by the position sensor 58 (see FIG. 8).

Then, in Step S5, it is determined whether the number of pulses reaches N1 (a predetermined number of pulses). Further, if the number of pulses reaches N1, the belt driving motor 56 (see FIG. 8) is controlled and the movement of the belt frame 43 is stopped in Step S6. For this reason, the cleaning belts 41 (see FIG. 8), which have been positioned at the home position at first, are moved along the going path until the number of pulses reaches the predetermined number of pulses (N1). Further, since the installation rollers 42 (see FIG. 9) are not rotationally driven due to the stop control of the belt rotating motor 46 (see FIG. 9) while the belt frame 43 is moved, the cleaning belts 41 are not rotated.

Accordingly, the cleaning belts 41 shown in FIG. 8 slide on the ink discharge surface 21 in the arrangement direction of the nozzles. Further, the cleaning belts are moved from the home position to a middle position (the position shown in FIG. 8) corresponding to the predetermined number of pulses (N1). As a result, during this time, standing ink, dirt, foreign materials, and the like, which are attached to the ink discharge surface 21, are wiped off by the movement of the cleaning belts 41 like a wiper.

Here, as shown in FIG. 7B, a stepped portion (a stepped portion having a difference in height of about 50 μm in this embodiment) between the head chip 31 and the flexible sheet 33 is formed on the ink discharge surface 21. Further, the cleaning belts 41, which are positioned on the peripheral surface of the installation roller 42 and made of an open cell porous foam having flexibility, water adsorbability, and air permeability, follow the stepped portion. For this reason, a gap is not formed at a corner of the stepped portion, and it may be possible to almost completely adsorb residual ink and the like existing at the corner of the stepped portion by a synergistic effect of this and a capillary force of a pore (cell) formed in the porous foam.

Meanwhile, when the residual ink and the like are wiped off, the contact portions (wiping portions) of the cleaning belts 41 coming into contact with the ink discharge surface 21 are contaminated. Further, if cleaning continues to be performed by the same contact portions of the cleaning belts, the cleaning performance deteriorates. For this reason, in this embodiment, in Step S6, the movement of the belt frame 43 (see FIG. 8) is stopped once at a middle position (between the cleaning start position and the cleaning end position) during the cleaning.

After that, the line head 20 is lifted and stands by in Step S7, so that a press contact state shown in FIG. 9 between the cleaning belts 41 and the ink discharge surface 21 is temporarily released. Further, in Step S8, the belt rotating motor 46 is rotationally driven in this state, so that the cleaning belts 41 are rotated by a desired angle. For this reason, the portions (wiping portions) of the cleaning belts, which are contaminated due to the contact with the ink discharge surface 21, are changed, so that cleaning performance is restored.

In this case, if the entire portions of the cleaning belts 41 have already come into contact with the ink discharge surface 21 once, a fresh portion does not appear even though the cleaning belts 41 are rotated. However, the front and back surfaces of the cleaning belts 41 come into contact with the air during the rotation of the cleaning belts 41, so that air permeability is improved and drying is facilitated. For this reason, since the water contained in the adsorbed ink is evaporated even at the wiping portions where adsorbability has deteriorated, adsorbability is restored. Accordingly, if the cleaning belts 41 are rotated, portions of the cleaning belts of which flexibility, water adsorbability, and air permeability are high can come into contact with the ink discharge surface 21. As a result, it may be possible to maintain high cleaning performance over a long period. Further, there is no concern that the cleaning belts 41 are contaminated due to the transfer of the adsorbed ink and the like to the ink discharge surface 21.

After cleaning performance is restored as described above, the line head 20 is lowered in Step S9 so that the ink discharge surface 21 and the cleaning belts 41 come into press contact with each other again as shown in FIG. 3. Further, in Step S10, the belt frame 43 (see FIG. 8) is moved again along the going path so as to perform cleaning, and the number of pulses rotationally driving the belt driving motor 56 (see FIG. 8) are counted. Furthermore, in Step S11, it is determined whether the number of pulses reaches a predetermined number of pulses (N2). If the number of pulses reaches N2, the movement of the belt frame 43 is stopped in Step S12. For this reason, the cleaning belts 41, which have been positioned at the middle position (the position shown in FIG. 8), is moved on the going path along the arrow until the number of pulses reaches the predetermined number of pulses (N2). Meanwhile, since the belt rotating motor 46 (see FIG. 9) is not rotationally driven in this case, the cleaning belts 41 are not rotated.

Accordingly, the cleaning belts 41 shown in FIG. 8 slide again on the ink discharge surface 21 in the arrangement direction of the nozzles. Further, the cleaning belts are moved from the middle position to the end position (the cleaning end position close to the tension pulley 55) according to the predetermined number of pulses (N2). As a result, during this time, standing ink, dirt, foreign materials, and the like, which are attached to the ink discharge surface 21, are wiped off by the movement of the cleaning belts 41 on the going path.

Cleaning corresponding to the entire going path is completed as described above, but cleaning corresponding to the return path is also performed in this embodiment. For this purpose, the line head 20 is lifted and stands by in Step S13 so that the cleaning performance corresponding to the return path does not deteriorate. Further, the cleaning belts 41 are rotated in the subsequent Step S14, the contact portions of the cleaning belts 41 coming into contact with the ink discharge surface 21 are changed.

After the cleaning performance is restored as described above, the line head 20 is lowered again in Step S15 so that the ink discharge surface 21 and the cleaning belts 41 come into press contact with each other again as shown in FIG. 3. After that, in Step S16, the belt frame 43 shown in FIG. 8 is moved in a direction opposite to the direction corresponding to the return path and the number of pulses rotationally driving the belt driving motor 56 is counted. Specifically, like the case of the cleaning along the going path, the ink discharge surface 21 is cleaned by moving the cleaning belts 41 from the end position to the middle position. Further, the cleaning belts 41 are rotated at the middle position (the position shown in FIG. 8), so that the cleaning performance is restored.

In addition, the cleaning belts 41 positioned at the middle position are moved up to the home position (the cleaning start position close to the moving drive pulley 54). Further, the movement of the cleaning belts up to the home position is controlled by the detection of the home position in Step S17. Specifically, if the home position of the belt frame 43 is detected by the position sensor 58, the belt frame 43 is stopped in the next Step S18. For this reason, the cleaning of the ink discharge surface 21 along the entire return path is completed like the case of the cleaning along the going path.

After the ink discharge surface 21 is completely cleaned as described above, the line head 20 is lifted and stands by in Step S19. Then, the cleaning device 40 retracts in Step S20, so that a series of cleaning operations is completed. Further, if printing is not performed thereafter, the ink discharge surface 21 of the line head 20 is sealed with the head cap 12 and protected in the last Step S21 as shown in FIG. 2. Furthermore, the drying, clogging, and the like of the ink discharge surface 21 can be prevented and the cleaning/maintenance program is then ended.

As described above, according to the inkjet printer 10 (and the method of controlling the inkjet printer 10) according to this embodiment, the cleaning belts 41 slide on the ink discharge surface 21, so that it may be possible to wipe off standing ink and the like attached to the ink discharge surface 21. Further, since the Mobius strip-shaped cleaning belts 41 are rotated at a predetermined timing so that the wiping portions are changed, it may be possible to perform cleaning while efficiently using both the front and back surfaces of the cleaning belt 41. Specifically, since the length of the wiping portion of both the front and back surfaces of the cleaning belt is twice as long as the length of the cleaning belt, it may be possible to lengthen the life of the cleaning belt 41. Meanwhile, if the same length of the wiping portion as the length of the cleaning belt is necessary (if the same length of the wiping portion as the length of one surface of the cleaning belt is necessary), it may be possible to make the length of the cleaning belt 41 be half (to reduce the length of the cleaning belt).

In addition, the cleaning belts 41 are provided so as to correspond to the nozzle arrays for the yellow (Y), magenta (M), cyan (C), and black (K) inks and the liquid ($\alpha$), respectively. Accordingly, the contamination caused by the mixing of colors is prevented, so that it may be possible to obtain a good cleaning effect over the entire surface of the ink discharge surface 21. Further, the invention is particularly effective for the line head 20 that has a large cleaning range and a large amount of adsorbed ink.

Further, the invention is not limited to the above-mentioned embodiment, and may have the following various modifications. That is, (1) This embodiment has been applied to the line inkjet printer 10 including the line head 20, but is not limited thereto. This embodiment may also be applied to a serial printer that performs printing while moving a head in the width direction of a recording sheet. Further, this embodiment may also be applied to a copying machine, a facsimile, and the like in addition to the printer.

(2) The guide shafts 52, the moving drive belt 53, the moving drive pulley 54, the tension pulley 55, the belt driving motor 56, and the movement transmitting belt 57 have been used as the moving unit for the belt frame 43 in this embodiment. However, the moving unit for the belt frame is not limited thereto, and may be formed of a gear, a belt, a cam, a piston, or a combination thereof. Further, the belt rotating motor 46, the rotation transmitting gears 47*a* and 47*b*, the rotation transmitting pulleys 48*a* and 48*b*, and the rotation transmitting belt 49 have been used as the rotational drive unit for the installation roller 42 in this embodiment. However, the rotational drive unit for the installation roller is not limited thereto, and may be formed of a gear, a belt, a cam, a piston, or a combination thereof.

(3) In this embodiment, the cleaning belts 41 are rotated at a predetermined timing between the cleaning start position and the cleaning end position, so that the wiping portions are changed. However, the number of times of the rotation of the cleaning belt is not limited. Further, the cleaning belts may be rotated at any position except for the middle position and the end position. Furthermore, the cleaning belt may not be rotated during the cleaning. In addition, the cleaning belts 41 have not been rotated during the movement of the belt frame 43 in this embodiment, but may be rotated in accordance with or regardless of the moving speed of the belt frame.

(4) In this embodiment, cleaning has been completed by one reciprocating motion of the belt frame 43. However, the invention is not limited thereto, and cleaning may be completed by one-way motion of belt frame or several reciprocating motions of the belt frame. Further, when printing is performed on a postcard by the inkjet printer 10 that can print over the width of, for example, an A4 sheet, cleaning may be performed only on the printing range of the ink discharge surface corresponding to the postcard (the ink discharge range corresponding to the postcard).

The present application contains subject matter related to that disclosed in Japanese Priority Patent Application JP 2009-030537 filed in the Japan Patent Office on Feb. 12, 2009, The entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid discharge apparatus comprising:

a plurality of nozzles that discharges a liquid;

a liquid discharge head that includes nozzle arrays where the respective nozzles are arranged in one direction;

cleaning belts that are formed in the shape of a Mobius strip and clean a portion of the liquid discharge head where the nozzle arrays are disposed by adsorbing liquid attached to the portion of the liquid discharge head;

installation rollers around which the cleaning belts are rotatably installed;

a support frame that supports the installation rollers so that an angle is formed between a width direction of the cleaning belt and the arrangement direction of the nozzles, and so that the cleaning belts positioned on peripheral surfaces of the installation rollers come into contact with the portion of the liquid discharge head where the nozzle arrays are disposed;

a moving means for moving the support frame in the arrangement direction of the nozzles; and a rotational drive means for rotationally driving the installation roller, wherein the support frame includes a first frame member and a second frame member, an upper link is pivotally coupled to the first frame member at a first node, and pivotally coupled to the second frame member at a second node, the installation rollers include an upper installation roller and a lower installation roller, and the upper installation roller is supported by the second frame member.

2. The liquid discharge apparatus according to claim 1, wherein the plurality of nozzles is provided in parallel in the liquid discharge head, and the cleaning belts are provided so as to correspond to the nozzle arrays, respectively.

3. The liquid discharge apparatus according to claim 1, wherein the liquid discharge head is a line head where the nozzles are arranged along a width of an object to which liquid is discharged.

4. The liquid discharge apparatus according to claim 1, further comprising:

a twist pressing part that presses ends of twisted portions of the Mobius strip-shaped cleaning belts so as to eliminate twist.

5. The liquid discharge apparatus according to claim 4, wherein the twist pressing part includes an intermediate roller that is provided inside the cleaning belts and disposed parallel to the installation rollers, and a twist pressing guide that is provided outside the cleaning belts and guides the cleaning belts so as to press the cleaning belts against the intermediate roller.

6. The liquid discharge apparatus according to claim 5, wherein the twist pressing guide includes a planar portion that faces the cleaning belts.

7. The liquid discharge apparatus according to claim 1, wherein a spring urges the second frame member toward the liquid discharge head.

8. The liquid discharge apparatus according to claim 7, wherein a lower link is pivotally coupled to the first frame member at a third node, and pivotally coupled to the second frame member at a fourth node, and the lower installation roller is supported by the second frame.

9. The liquid discharge apparatus according to claim 1, wherein the cleaning belts consist of five cleaning belts.

10. A liquid discharge apparatus comprising:

a plurality of nozzles that discharges a liquid;

a liquid discharge head that includes nozzle arrays where the respective nozzles are arranged in one direction;

cleaning belts that are formed in the shape of a Mobius strip and clean a portion of the liquid discharge head where the nozzle arrays are disposed by adsorbing liquid attached to the portion of the liquid discharge head;

installation rollers around which the cleaning belts are rotatably installed;

a support frame that supports the installation rollers so that an angle is formed between a width direction of the cleaning belt and the arrangement direction of the nozzles, and so that the cleaning belts positioned on peripheral surfaces of the installation rollers come into contact with the portion of the liquid discharge head where the nozzle arrays are disposed;

a moving unit configured to move the support frame in the arrangement direction of the nozzles; and a rotational drive unit configured to rotationally drive the installation roller, wherein the support frame includes a first frame member and a second frame member, an upper link is pivotally coupled to the first frame member at a first node, and pivotally coupled to the second frame member at a second node, the installation rollers include an upper installation roller and a lower installation roller, and the upper installation roller is supported by the second frame member.

* * * * *